US007931510B2

(12) United States Patent
Fukase

(10) Patent No.: US 7,931,510 B2
(45) Date of Patent: Apr. 26, 2011

(54) CRIMP CONTACT DEVICE WITH ADJUSTED CRIMPING FORCE

(75) Inventor: Yoshihiro Fukase, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/732,759

(22) Filed: Mar. 26, 2010

(65) Prior Publication Data

US 2010/0248559 A1 Sep. 30, 2010

(30) Foreign Application Priority Data

Mar. 27, 2009 (JP) ..... 2009-078909

(51) Int. Cl.
*H01R 4/10* (2006.01)

(52) U.S. Cl. ..... 439/878; 439/442

(58) Field of Classification Search ..... 439/877, 439/878, 879, 880, 421, 442, 775
See application file for complete search history.

(56) References Cited

U.S. PATENT DOCUMENTS

| | | | | |
|---|---|---|---|---|
| 2,692,422 | A * | 10/1954 | Pierce | 29/865 |
| 3,955,044 | A * | 5/1976 | Hoffman et al. | 174/84 C |
| 7,008,274 | B2 * | 3/2006 | Hayashi et al. | 439/877 |
| 7,306,495 | B2 * | 12/2007 | Hashimoto et al. | 439/877 |
| 2010/0035482 | A1 * | 2/2010 | Nakamura et al. | 439/775 |
| 2010/0144189 | A1 * | 6/2010 | Watanabe et al. | 439/421 |

FOREIGN PATENT DOCUMENTS

JP 2003-168536 A 6/2003

* cited by examiner

*Primary Examiner* — Hae Moon Hyeon
(74) *Attorney, Agent, or Firm* — Sughrue Mion, PLLC

(57) ABSTRACT

A crimp contact device includes a crimping member. The crimping member is configured to crimp a wire, and has a first portion and a second portion which is near to an end of the crimping member than the first portion. A pressure applied to the wire by the second portion is decreased according to a direction from the first portion toward the end of the crimping member.

6 Claims, 7 Drawing Sheets

CRIMP CONTACT DEVICE WITH ADJUSTED CRIMPING FORCE

CROSS-REFERENCES TO RELATED APPLICATIONS

This application claims the benefit of Japanese Patent Application No. 2009-078909 filed Mar. 27, 2009, the disclosure of which including specification, drawings and claims is incorporated herein in its entirety by reference.

BACKGROUND

The present invention relates to a crimp contact device and more particularly to, for example, a crimp contact device for crimping a contact metal firmly against a core wire of a covered electric wire.

FIGS. 1A and 1B show an example of a crimp contact device of this type (refer to Patent Document 1, for example). As is shown in FIG. 1A, a core wire 191 of an electric wire 190 is crimped by a core wire crimping portion 130 which lies at a substantially central portion of the crimp contact device 110 to thereby be attached to a crimp contact device 110. In a technique disclosed in Patent Document 1, as is shown in FIG. 1B, a bell-mouth portion 133, which is formed so that an end portion thereof is opened to be oriented outwards, is provided so as to prevent the core wire 191 from being damaged to be disconnected by an end portion of the core wire crimping portion 130 in such a state that the core wire 191 is crimped by the core wire crimping portion 130. In FIG. 1B, an area P1 is an area where the core wire 191 is compressed so as to be completely crimped, and an area P2 is an area where the core wire 191 is not compressed.

[Patent Document 1] Japanese Patent Publication No. 2003-168536 A

Incidentally, as has been described above, in the crimp contact device 110 to which the electric wire 190 is attached via the bell-mouth portion 130 provided thereon, there has sometimes happened a situation in which the securing force is insufficient at the portion where the core wire 191 of the electric wire is crimped by the core wire crimping portion 130. As a result of studies carried out, it has been found that a reduction in securing force is possible to occur due to stress concentration at an end portion Y (a boundary portion between the core wire crimping portion 130 and the bell-mouth portion 133) of the core wire crimping portion 130 where the electric wire 190 (the core wire 191) is crimped and that particularly, in the case of an electric wire (a core wire) which is thin in diameter, there is a fear that the securing force becomes insufficient. In addition, as is shown in FIG. 1C, since stress varies drastically at an area S1, there has been a case where the core wire 191 is disconnected.

SUMMARY

It is therefore one advantageous aspect of the present invention is to provide a technique that can solve the problems described above.

According to one aspect of the invention, there is provided a crimp contact device, comprising:

a crimping member, configured to crimp a wire, and having a first portion and a second portion which is near to an end of the crimping member than the first portion, wherein a pressure applied to the wire by the second portion is decreased according to a direction from the first portion toward the end of the crimping member.

The crimp contact device may further comprise: a bell-mouth part, including the second portion, and extending from the first portion in a first direction inclined at a first angle with respect to a second direction in which the first portion is elongated, wherein a distance between the bell-mouth part and a base portion opposing both of the first portion and the second portion is increased according to the first direction.

The crimp contact device may be configured such that: the wire has a transiting portion defined as an area between a first position where a diameter of the wire becomes to be decreased and a second position opposing an end of the second portion, the end of the second portion being opposite to the end of the crimping member, and the first angle is larger than a second angle between the second direction and a third direction from the second position to the first position.

The crimp contact device may be configured such that: the wire the first angle is substantially equal to the second angle.

The crimp contact device may be configured such that: the transiting portion has a first part including the first position and a second part including the second position, the pressure is applied to the second part, and no pressure is applied to the first part by the crimping member.

According to another aspect of the invention, there is provided a crimping apparatus, comprising: the crimp contact device; a first die configured to apply a pressure to the crimping member, and including an end portion having tapered shape; and a second die configured to support the base portion, wherein the crimping member is disposed between the first die and the second die, wherein the first angle is defined by the tapered shape.

DETAILED DESCRIPTION OF EXEMPLIFIED EMBODIMENTS

A crimp contact device 10 is formed by punching a base material out of a conductive base plate and bending it and is made up of an electric contact portion 20, a core wire crimping portion 30 and an electric wire crimping portion 40 which are provided sequentially in that order from a left-hand side of the figure. In this embodiment, as a matter of convenience, the crimp contact device 10 will be described on the understanding that a side of the crimp contact device 10 where the electric contact portion 20 (the left-hand side in the figure) lies is regarded as front and a side where the electric wire crimping portion 40 (a right-hand side in the figure) lies as rear.

Figure 2A:
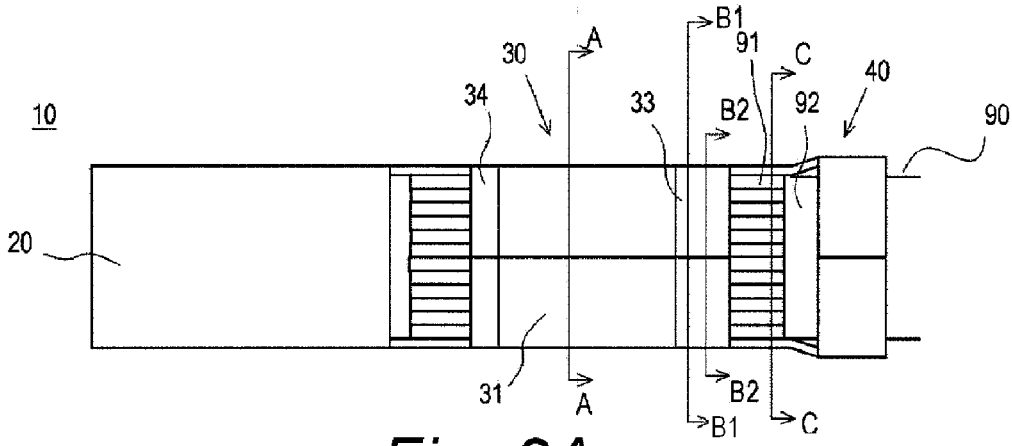
FIG. 2A is a plan view showing a state in which a core wire crimping portion of a crimp contact device according to one embodiment of the present invention is crimped.
Figure 2B:
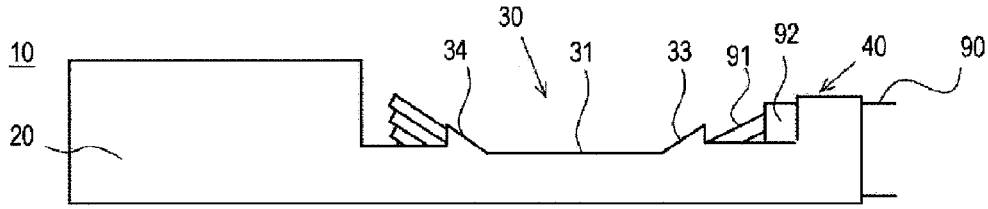
FIG. 2B is a side view showing the state in which the core wire crimping portion shown in FIG. 2A is crimpled.
Figure 2C:
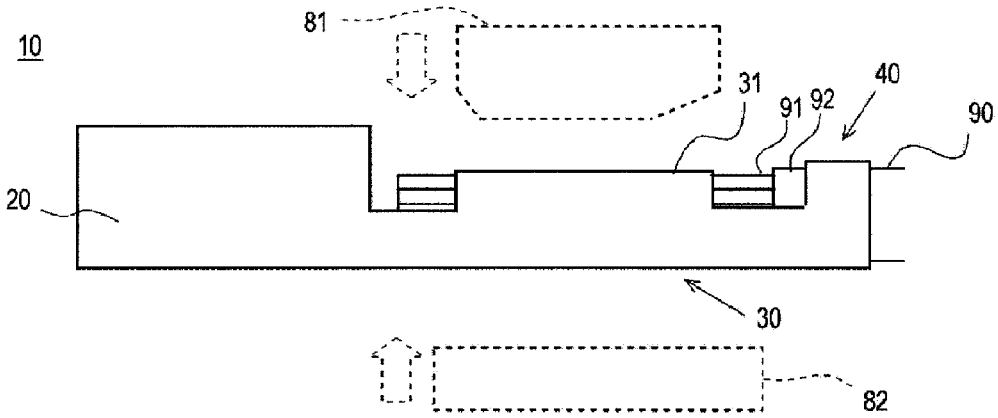
FIG. 2C is a side view showing a state resulting before the core wire crimping portion shown in FIG. 2A is crimped.

As is shown in FIG. 2C, in the crimp contact device 10, a crimping piece 31 is bent to crimp an electric wire 90, and thereafter an area where the core wire crimping portion 30 lies is crimped by an upper crimping die 81 and a lower crimping die 82 into a state shown in FIG. 2B, whereby a core wire 91 is secured.

Here, the electric contact portion 20 is of a female type and is formed into a box-like shape which is opened at one longitudinal side (a left-hand side in the figure). An electric contact portion of a crimp contact device of a male type is designed to be inserted into the electric contact portion 20.

The core wire crimping portion 30 is formed between the electric contact portion 20 and the electric wire crimping portion 40 and is designed to crimp the core wire 91, which is bared by stripping partially a covering of the electric wire 90, by being crimped by the crimping dies. The electric wire crimping portion 40 is designed to crimp a covered wire 92 of the electric wire 90.

The crimping piece 31 of the core wire crimping portion 30 is worked into a state shown in FIG. 2C by a predetermined contact crimping machine (not shown) which includes the upper crimping die 81 and the lower crimping die 82. When the crimping piece 31 is so crimped by the crimping machine, an upper surface of the crimping piece 31, which is now in a bent state, is formed into a straight line which extends in a front-rear direction. Next, the predetermined crimping dies (the upper crimping die 81 and the lower crimping die 82) are applied to the crimp contact device 10 in that state, whereby the core wire crimping portion 30 is crimped.

Figure 3:
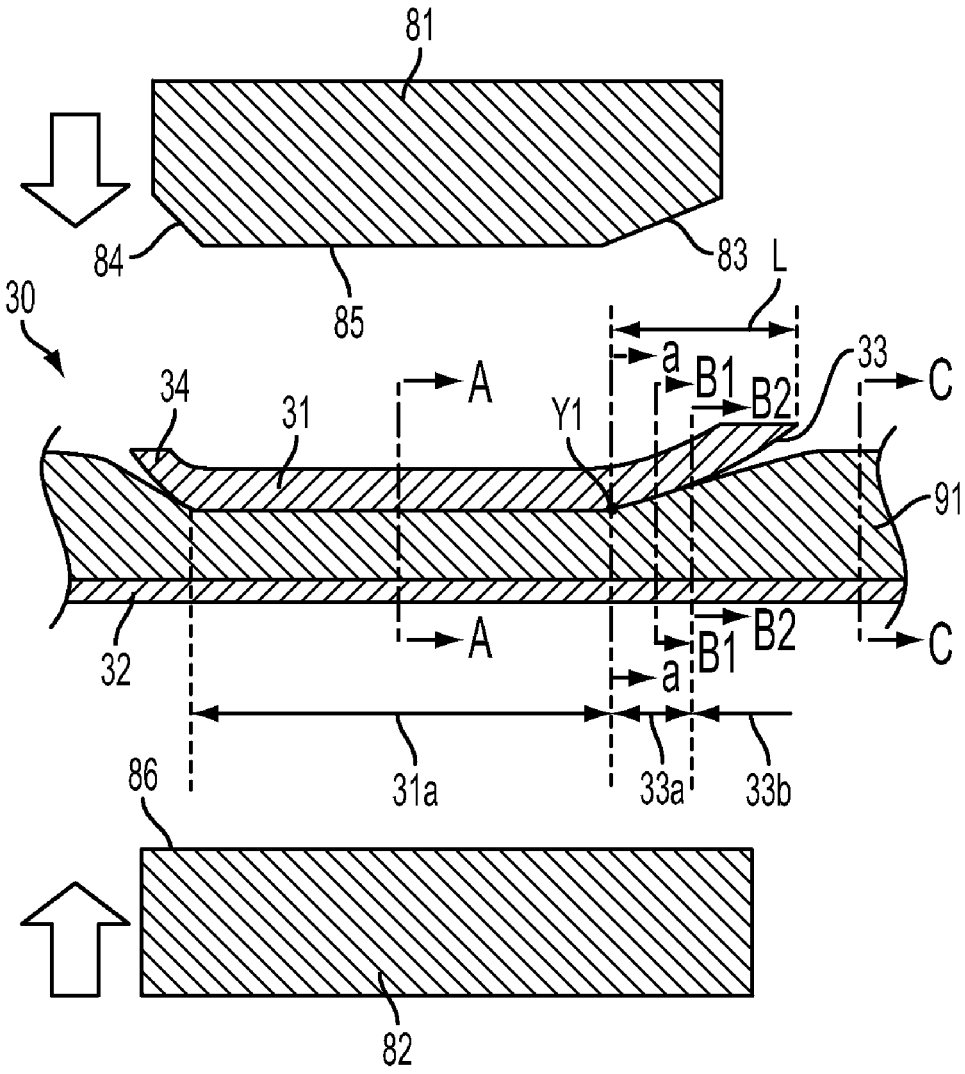
FIG. 3 is a side view showing an inner construction of the core wire crimping portion shown in FIG. 2A.

In the upper crimping die 81, desired tapering portions 83, 84 are provided at a rear end portion and a front end portion, respectively, of a crimping surface 85 which is oriented downwards. On the other hand, in the lower crimping die 82, an upwardly oriented crimping surface 86 is formed flat thereover. Consequently, when the core wire crimping portion 30 is crimped by the upper crimping die 81 and the lower crimping die 82, as is shown in FIGS. 2B and 3, a rear bell-mouth portion 33 and a front bell-mouth portion 34, which are pad portions, are formed at a rear-side portion and a front-side portion of the crimping piece 31, respectively. Hereinafter, the rear bell-mouth portion 33 will mainly be described. Although a length L of the rear bell-mouth portion 33 is not determined particularly, the rear bell-mouth portion 33 is preferably formed so as to extend 1 mm or longer in the front-rear direction.

Figure 4A:
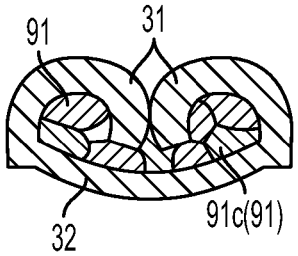
FIG. 4A is a sectional view taken along a line A-A in FIG. 2A.

As the inner construction of the crimp contact device 10 in FIG. 3 shows, a complete compression portion 31*a* is formed at a central portion of the crimping piece 31 of the core wire crimping portion 30, and an upper surface of the complete compression portion 31*a* is formed substantially horizontal. As is shown in FIG. 4A which shows a sectional view taken along the line A-A in FIG. 2A or an A-A sectional view, the core wire 91 is crimped by the crimping piece 31 and is in a completely compressed state. A portion lying further forwards than a position where the rear bell-mouth portion 33 is started to be formed or a rear bell-mouth portion formation starting position Y1 is in the state shown in the A-A sectional view. In addition, at a portion where the front bell-mouth portion 34 is formed, the crimping piece 31 and the core wire 91 are in a completely spaced-apart state all over the areas as in the case of the related art bell-mouth portions. The core line 91 at the complete compression portion 31*a* is referred to as a core wire compression portion 91*c* (refer to FIG. 5B). Further, the core wire 91 may be a core wire group which is made up of a plurality of conductive wires. However, for the purpose of facilitation of understanding, the core wire 91 is shown as being a single core wire.

Figure 5A:
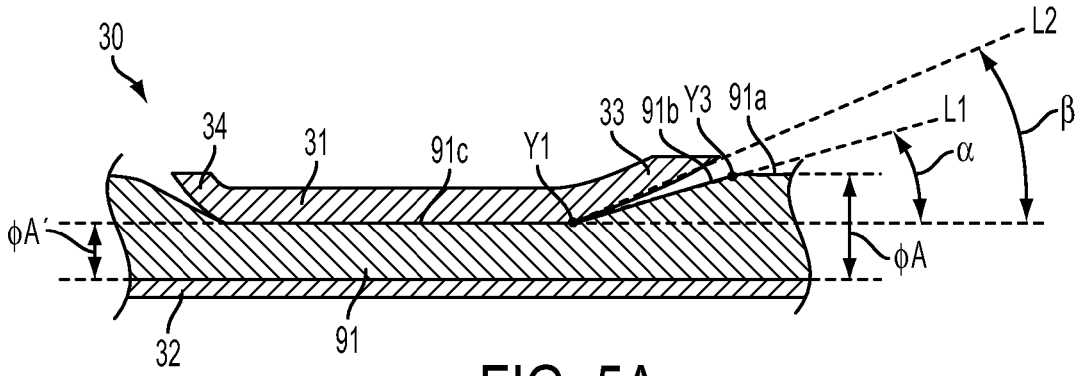
FIG. 5A shows a shape of the core wire crimping portion shown in FIG. 2A.
Figure 5B:
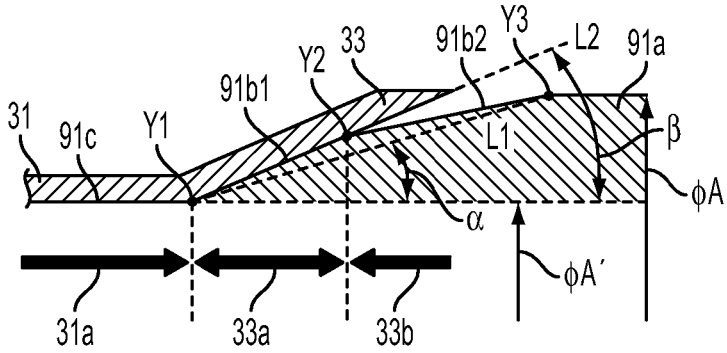
FIG. 5B shows a rear bell-mouth portion of the core wire crimping portion shown in FIG. 2A.

FIGS. 5A and 5B show diagrams showing shapes of the rear bell-mouth portion 33 and the core wire 91 while paying attention to angles mainly. As is shown in FIG. 5A, the core wire 91 tapers as it extends to the front within an interior of the rear bell-mouth portion 33, that is, an area extending between the rear bell-mouth portion 33 and a base plate portion 32. This portion where the core wire 91 so tapers (Y1 to Y3) is referred to as a core wire gradually tapering portion 91*b*. In addition, a portion where the core wire 91 is not compressed is referred to as a core wire non-compression portion 91*a*. Further, a conductor diameter at the core wire non-compression portion 91*a* is denoted by ϕA and a compressed conductor diameter at the core wire compression portion 91*c* is denoted by ϕA'.

Figure 4B:
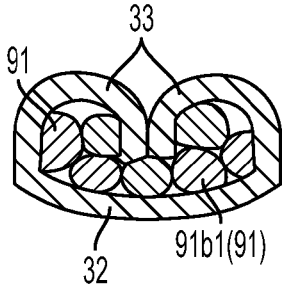
FIG. 4B is a sectional view taken along a line B1-B1 in FIG. 2A.
Figure 4C:
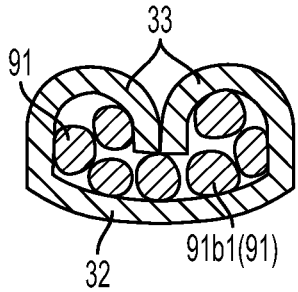
FIG. 4C is a sectional view taken along a line B2-B2 in FIG. 2A.
Figure 4D:
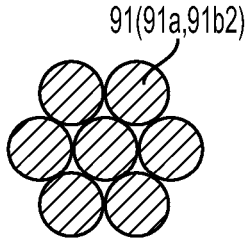
FIG. 4D is a sectional view taken along a line C-C in FIG. 2A.

When looking at the core wire gradually tapering portion 91*b* in detail, as is shown in FIG. 5B, the core wire gradually tapering portion 91*b* is in contact with an inner surface of the rear bell-mouth portion 33 only over a predetermined area which extending from the rear bell-mouth portion formation starting position Y1 to an intermediate position Y2. This portion on the core wire gradually tapering portion 91*b* is referred to as a primary core wire gradually tapering portion 91*b*1. In addition, this portion on the rear bell-mouth portion 33 is referred to as an intermediate compression portion 33*a*. The cross section taken along the line B1-B1 or the B1-B1 cross section shown in FIG. 4B and the cross section taken along the line B2-B2 or the B2-B2 cross section shown in FIG. 4C represent a sectional shape of the intermediate compression portion 33*a*. When compared with the cross section taken along the line A-A in FIG. 4A, the compressed condition of the core wire 91 is relaxed at the intermediate compression portion 33*a*. Further, as is seen from a comparison between the B1-B1 cross section and the B2-B2 cross section, the compressed condition is relaxed more as the intermediate compression portion 33*a* extends towards the rear. The core wire gradually tapering portion 91*b* is spaced apart from the rear bell-mouth portion 33 rearwards of the intermediate position Y2. A portion (Y2 to Y3) of the core wire gradually tapering portion 91*a* lying on the intermediate position Y2 side is referred to as a secondary core wire gradually tapering portion 91*b*2 and if provided in non -contacting portion 33*b*.

Here, an angle is referred to as a bell-mouth angle (α) which is formed by a primary straight line Ll which connects the rear bell-mouth portion formation starting portion Y1 which constitutes a front end portion with a rear end portion Y3 of the core line gradually tapering portion 91*b* and a horizontal plane. In addition, an angle is referred to as a conductor bell-mouth portion angle (β) which is formed by a straight line which indicates a direction in which the rear bell-mouth portion 33 is opened (here, a straight line L2 which indicates the inner surface of the rear bell-mouth portion 33) and the horizontal plane. The bell-mouth angle (α) is determined by the conductor diameter ϕA of the core wire non-compression portion 91*a*, the compression conductor diameter ϕA' of the core wire compression portion 91*c* and an end portion of a crimping position of the crimping piece 31 (the formation starting position Y1) Yl. In addition, the conductor bell-mouth portion angle (β) is determined by a shape of the tapering portion 84 of the upper crimping die 81.

As shown, the rear bell-mouth portion 33 is expanded further outwards (a direction in which a distance between the bell-mouth portion 33 and the base plate portion 32 is increased) as it extends further rearwards. In this case, by setting the degree of opening of the rear bell-mouth portion 33, that is, the conductor bell-mouth portion angle (β) which is an angle at which the rear bell-mouth portion 33 is expanded outwards to a predetermined value, the rear bell-mouth portion 33 and the core wire 91 are not spaced apart from each other immediately at the rear end portion Y1 of the complete compression portion 31*a*. Instead, as is shown by the cross-sectional shapes in FIGS. 4B and 4C, the compressed condition of the rear bell-mouth portion 33 against the core wire 91 is gradually relaxed, so that they can be spaced apart from each other eventually.

Figure 1A:
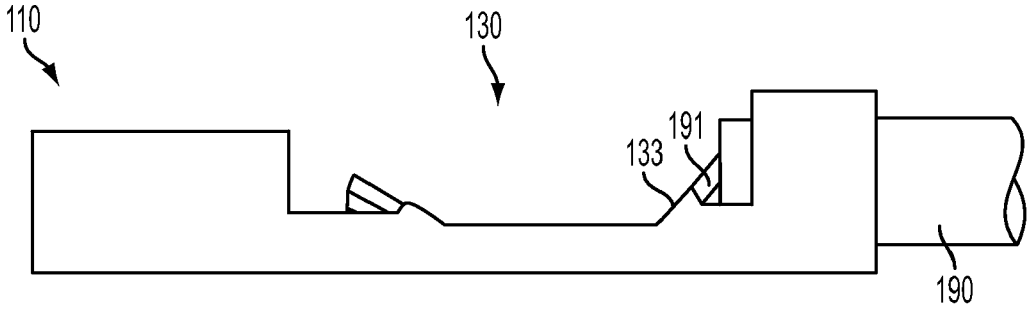
FIG. 1A PRIOR ART
FIG. 1A is a side view of a crimp contact device according to a related-art.
Figure 1B:
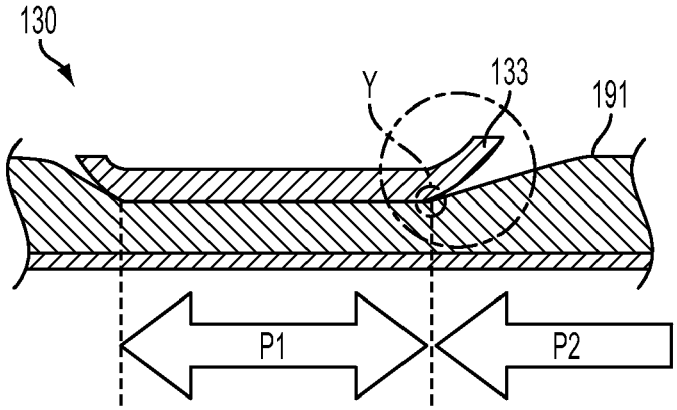
FIG. 1B RELATED ART
FIG. 1B shows exemplarily a section of a core wire crimping portion of the crimp contact device shown in FIG. 1A.
Figure 1C:
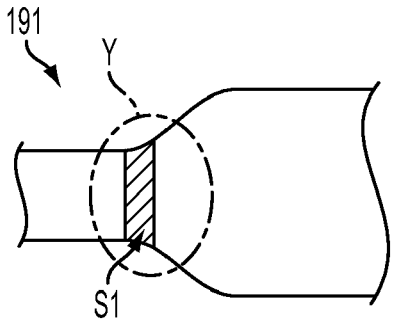
FIG. 1C RELATED ART
FIG. 1C shows exemplarily a shape of a gradually tapering portion of a core wire according to the related-art.
Figure 6:
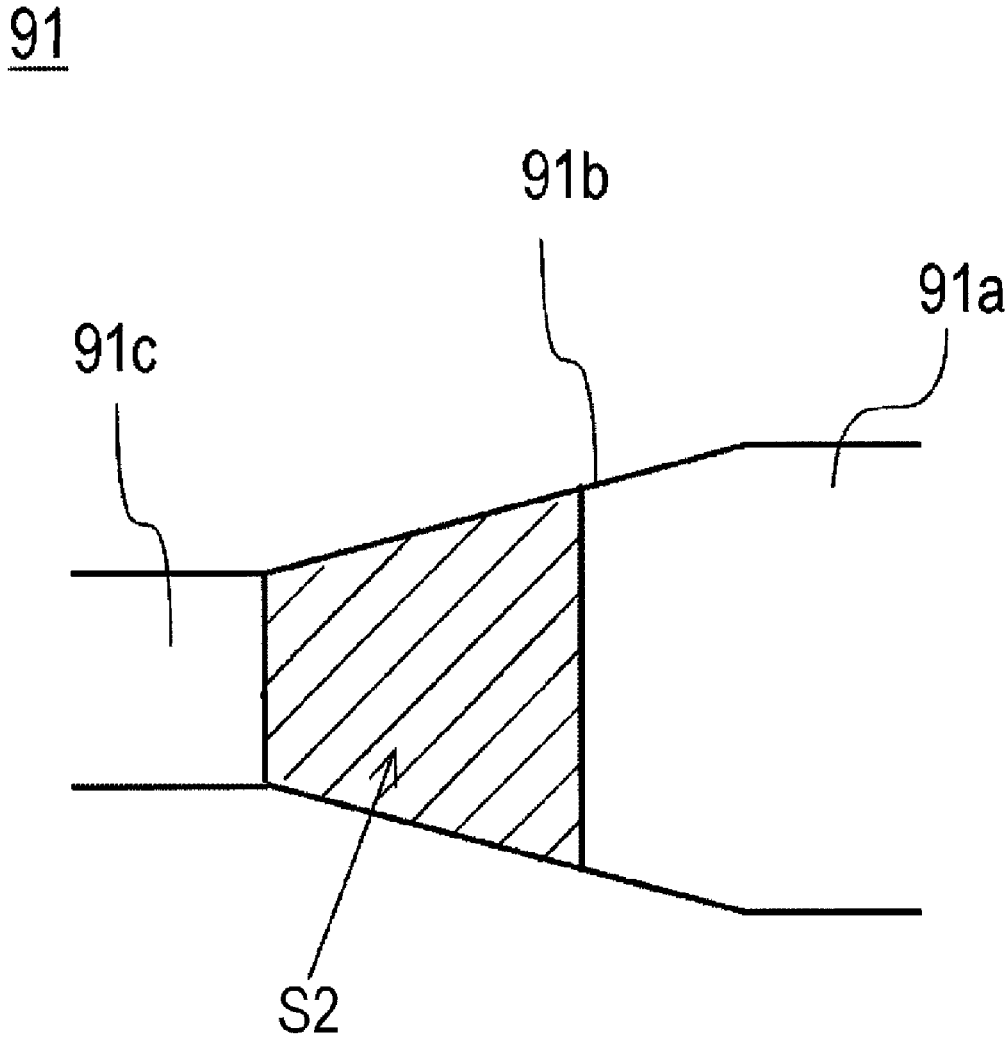
FIG. 6 shows exemplarily a shape of a gradually tapering portion of a core wire according to the embodiment of the present invention.
Figure 7:
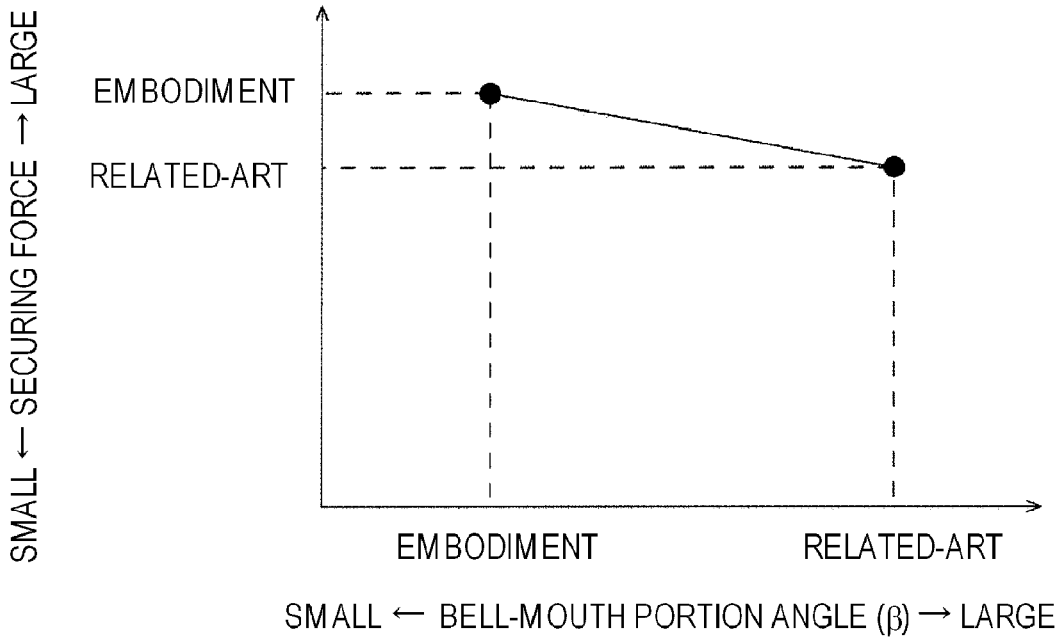
FIG. 7 shows a securing force of the crimp contact device shown in FIG. 2A in comparison with that of the related-art.

More specifically, the conductor bell-mouth portion angle (β) is set to an angle which is larger than but is relatively close to the bell-mouth angle (α). By setting the bell-mouth angle (α) and the conductor bell-mouth portion angle (β) in the way described above, the compressed state of the core wire 91 at the rear bell-mouth portion 33 or the degree of compression of the core wire 91 by the rear bell-mouth portion 33 can be changed bit by bit between the A-A cross section to the B2-B2 cross section shown in FIGS. 4A to 4D. In the related-art bell-mouth construction, since the compressed state of the core wire 91 is changed drastically from the compression portion to the non-compression state as has been described before, there was a large change in stress (refer to FIG. 1C). Because of this, there has been a fear that the core wire 91 is disconnected or a reduction in securing force is caused. In the embodiment, however, as is shown in FIG. 6, stress produced when the core wire is pulled as it is compressed can be dispersed over a wider range, shown as an area S2, than that of the related-art. Because of this, a stress change occurring at the core wire gradually tapering portion 91*b* can be relaxed. As a result, the disconnection of the core wire 91 is made difficult to occur. In addition, the securing force between the core wire 91 and the core wire crimping portion 30 can be improved. FIG. 7 shows a difference in securing force between the related-art and the embodiment. As is shown in the figure, the securing force can be increased by setting the conductor bell-mouth portion angle (β) to the angle which is larger than but is relatively close to the bell-mouth angle (α) and making the angle at which the rear bell-mouth portion 33 is expanded (the conductor bell-mouth portion angle (β) smaller.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, while the crimp contact device is described as being of the female type, the invention can be applied to a crimp contact device of a male type. In addition, the invention can also be applied to a crimp contact device of a different type from the one for crimping the electric wire.

What is claimed is:

1. A crimp contact device, comprising:

a core wire crimping portion, which has been deformed so as to be crimped onto a wire, and having a complete compression portion and an intermediate compression portion, wherein the intermediate compression portion is nearer to an end of the core wire crimping portion than the complete compression portion, and wherein a pressure applied to the wire by the intermediate compression portion gradually decreases along a longitudinal direction of the crimp contact device which extends from the complete compression portion toward the end of the core wire crimping portion.

2. The crimp contact device as set forth in claim 1, further comprising:

a base portion;

wherein the wire is sandwiched between the base portion and the core wire crimping portion, wherein the core wire crimping portion further comprises a bell-mouth part, which includes the intermediate compression portion, wherein the complete compression portion is elongated along a first direction, wherein the bell-mouth part extends from the complete compression portion in a second direction which is inclined at a first angle with respect to the first direction, and wherein a distance between the bell-mouth part and the base portion increases along the longitudinal direction of the crimp contact device.

3. The crimp contact device as set forth in claim 2, wherein:

the wire has a transiting portion defined as an area between a first position where a diameter of the wire begins to be decreased and a second position which opposes an end of the intermediate compression portion, the end of the intermediate compression portion being opposite to the end of the core wire crimping portion, and the first angle is larger than a second angle between the first direction and a third direction which extends from the second position to the first position.

4. The crimp contact device as set forth in claim 2, wherein:

the wire has a transiting portion defined as an area between a first position where a diameter of the wire begins to be decreased and a second position which opposes an end of the intermediate compression portion, the end of the intermediate compression portion being opposite to the end of the core wire crimping portion, and the first angle is substantially equal to a second angle between the first direction and a third direction which extends from the second position to the first position.

5. The crimp contact device as set forth in claim 3, wherein:

the transiting portion has a first part including the first position and a second part including the second position, the pressure is applied to the second part, and no pressure is applied to the first part by the core wire crimping portion.

6. A crimping apparatus, comprising:

the crimp contact device set forth in claim 2;

a first die configured to apply a pressure to the core wire crimping portion, and including an end portion having tapered shape; and a second die configured to support the base portion, wherein the core wire crimping portion is disposed between the first die and the second die, wherein the first angle is defined by the tapered shape.

* * * * *